US011814228B2

(12) United States Patent
Takano et al.

(10) Patent No.: US 11,814,228 B2
(45) Date of Patent: Nov. 14, 2023

(54) POUCH

(71) Applicant: Fuji Seal International, Inc., Osaka (JP)

(72) Inventors: Tadashi Takano, Osaka (JP); Masahiro Kaminaga, Osaka (JP); Atsushi Yamamoto, Osaka (JP)

(73) Assignee: Fuji Seal International, Inc., Osaka (JP)

( * ) Notice: Subject to any disclaimer, the term of this patent is extended or adjusted under 35 U.S.C. 154(b) by 23 days.

(21) Appl. No.: 17/591,970

(22) Filed: Feb. 3, 2022

(65) Prior Publication Data

US 2022/0250821 A1 Aug. 11, 2022

(30) Foreign Application Priority Data

Feb. 5, 2021 (JP) ..... 2021-017221

(51) Int. Cl.
*B65D 75/00* (2006.01)
*B65D 75/58* (2006.01)

(52) U.S. Cl.
CPC ..... *B65D 75/008* (2013.01); *B65D 75/5877* (2013.01); *B65D 2575/586* (2013.01)

(58) Field of Classification Search
CPC ..... B65D 75/008; B65D 75/5877; B65D 2575/586
USPC ..... 222/107
See application file for complete search history.

(56) References Cited

U.S. PATENT DOCUMENTS 5,843,540 A * 12/1998 Heydarpour ..... B65D 75/008 383/906
5,960,993 A * 10/1999 Mitsui ..... B65D 33/02 222/105
6,241,122 B1 * 6/2001 Araki ..... B65D 51/223 222/464.2
6,244,467 B1 * 6/2001 Lewit ..... B65D 55/16 222/541.6

(Continued)

FOREIGN PATENT DOCUMENTS

CN 1326754 7/2007
JP 2015 009847 A 1/2015

(Continued)

OTHER PUBLICATIONS

European Search Report dated May 18, 2022 for Application No. 22154928.0, 8 pages.

(Continued)

*Primary Examiner* — Paul R Durand
*Assistant Examiner* — Michael J. Melaragno
(74) *Attorney, Agent, or Firm* — Frost Brown Todd LLP

(57) ABSTRACT

A pouch includes a packaging bag including a front surface sheet, a back surface sheet, a bottom surface sheet, and a top surface sheet and a spout. The packaging bag includes a pair of side seal portions, a front bottom seal portion, a back bottom seal portion, a front top seal portion, and a back top seal portion. At least one of the pair of side seal portions includes a side enclosing portion in which a gas is enclosed, the side enclosing portion having an elongated shape in a height direction. At least one of the front top seal portion or the back top seal portion includes a top enclosing portion in which a gas is enclosed, the top enclosing portion having an elongated shape in a width direction.

6 Claims, 12 Drawing Sheets

(56) References Cited

U.S. PATENT DOCUMENTS 6,578,740 B1 * 6/2003 Hagihara ..... B65D 75/5883 222/107
6,702,462 B2 * 3/2004 Richardson ..... B65D 75/5811 222/541.6
7,959,045 B2 * 6/2011 Kuge ..... B65D 47/123 220/717
8,083,102 B2 * 12/2011 Murray ..... B65D 75/5883 222/541.9
8,178,140 B2 * 5/2012 Kuboi ..... B65D 1/0292 220/666
8,181,823 B2 * 5/2012 Fukuizumi ..... B65B 61/186 222/107
8,459,512 B2 * 6/2013 Arvizu ..... B65D 75/5883 222/525
8,474,665 B2 * 7/2013 Arvizu ..... B65D 47/243 222/525
9,604,759 B2 * 3/2017 Mitsui ..... B65D 33/14
9,682,537 B2 6/2017 Stanley et al.
10,940,657 B2 * 3/2021 Nii ..... B65B 43/52
2001/0027984 A1 * 10/2001 Ichikawa ..... B65D 75/5883 222/533
2002/0110291 A1 * 8/2002 Edwards ..... B65D 75/5877 383/104
2002/0141663 A1 * 10/2002 Edwards ..... B65D 33/065 383/104
2004/0079764 A1 * 4/2004 Balz ..... B65D 75/5883 222/105
2004/0164094 A1 * 8/2004 Jackson ..... B65D 35/10 222/107
2005/0173455 A1 * 8/2005 Hagihara ..... B65D 75/5883 222/107
2006/0006194 A1 * 1/2006 Niggemyer ..... B65D 75/5883 222/107
2006/0108375 A1 * 5/2006 Pritchard ..... B65D 75/5866 222/107
2007/0047851 A1 * 3/2007 Sato ..... B29C 66/3452 383/906
2007/0051746 A1 * 3/2007 De Laforcade .... B65D 75/5883 222/572
2008/0037910 A1 * 2/2008 Matsumoto ..... B41J 2/17553 222/107
2008/0247682 A1 * 10/2008 Murray ..... B31B 70/00 53/457
2010/0025429 A1 * 2/2010 Ager ..... B65B 9/20 493/264
2010/0243670 A1 * 9/2010 Tysiac ..... B24B 57/00 222/1
2012/0125947 A1 * 5/2012 Becker ..... B65D 75/5816 222/105
2013/0001252 A1 * 1/2013 Murray ..... B65D 75/5883 222/107
2013/0292287 A1 * 11/2013 Stanley ..... B65D 25/14 206/459.5
2013/0292415 A1 * 11/2013 Stanley ..... B65D 75/008 222/206
2015/0048112 A1 * 2/2015 Skillin ..... B65D 75/5883 222/107
2015/0122842 A1 * 5/2015 Berg, Jr. ..... B65D 75/008 222/173
2015/0321819 A1 11/2015 Araki et al.
2016/0304261 A1 * 10/2016 Takano ..... B65D 75/56
2017/0144822 A1 * 5/2017 Murray ..... B65D 75/5866
2017/0208797 A1 * 7/2017 Murray ..... A01N 65/16
2017/0290740 A1 * 10/2017 Subramanian ..... A61J 1/1475
2020/0407120 A1 * 12/2020 Shibutani ..... B65D 33/02
2021/0315436 A1 * 10/2021 Lyon ..... B65D 83/0805
2021/0402747 A1 * 12/2021 Oura ..... B65D 75/008
2022/0017289 A1 * 1/2022 Li ..... B65D 33/10
2022/0250821 A1 * 8/2022 Takano ..... B65D 75/5877
2023/0072263 A1 * 3/2023 Takano ..... B65D 75/5877
2023/0125029 A1 * 4/2023 Akino ..... C08F 36/06 524/59

FOREIGN PATENT DOCUMENTS

JP 2016/068962 5/2016
JP 2016/216046 12/2016
JP 2017/056998 3/2017
JP 2018/165171 10/2018
JP 2020/083426 6/2020
WO WO-2020070866 A1 * 4/2020 ..... B32B 1/02
WO WO-2020110865 A1 * 6/2020 ..... B65D 33/00
WO WO-2020202529 A1 * 10/2020 ..... B32B 27/08

OTHER PUBLICATIONS

Written Opinion of the International Searching Authority dated May 4, 2022 for International Application No. PCT/JP2022/002393, 3 pages.

* cited by examiner

POUCH

TECHNICAL FIELD

This invention relates to a pouch.

BACKGROUND ART

A pouch having high self-standing characteristics is known. For example, the pouch described in JP 2015-9847 A includes a first side-surface film, a second side-surface film, a bottom film, and a discharge portion. A storage portion is formed by sealing together peripheral portions of the films that come into contact with one another. A gas injection portion having an elongated shape in a vertical direction is formed in a side edge portion of the pouch. The gas injection portion increases the rigidity of the side edge portion, thus increasing the self-standing stability of the pouch.

CITATION LIST

Patent Literature Patent Document 1: JP 2015-9847 A

SUMMARY OF INVENTION

Technical Problem. With a pouch such as that described in JP 2015-9847 A, conceivably, a top surface sheet may be additionally provided to secure greater volume for a housing portion where the contents are housed. However, in a case where a spout is fixed to the top surface sheet, if the top surface sheet bends when the contents are being discharged, for example, it may be difficult to discharge the contents.

An object of the present invention is to provide a pouch that can suppress bending of a top surface sheet.

Solution to Problem. A pouch according to an aspect of the invention includes: a packaging bag including a front surface sheet, a back surface sheet, a bottom surface sheet, and the top surface sheet and configured to house contents; and a spout fixed to the top surface sheet and configured to discharge the contents, wherein the packaging bag includes a pair of side seal portions formed by sealing together end portions of the front surface sheet and end portions of the back surface sheet in a width direction and each having an elongated shape in a height direction, a front bottom seal portion formed by sealing together the front surface sheet and the bottom surface sheet, a back bottom seal portion formed by sealing together the back surface sheet and the bottom surface sheet, a front top seal portion formed by sealing together the front surface sheet and the top surface sheet, and a back top seal portion formed by sealing together the back surface sheet and the top surface sheet; at least one of the pair of side seal portions includes a side enclosing portion in which a gas is enclosed, the side enclosing portion having an elongated shape in the height direction; and at least one of the front top seal portion or the back top seal portion includes a top enclosing portion in which a gas is enclosed, the top enclosing portion having an elongated shape in the width direction.

With the pouch including the bottom surface sheet and the top surface sheet, volume for the packaging bag is secured, and with the pouch including the top enclosing portion, bending of the top surface sheet when the contents are discharged from the spout or the pouch is transported is suppressed.

Also, the spout is preferably fixed to a portion of the top surface sheet separated from the top enclosing portion in the width direction.

With this aspect, the top enclosing portion does not make the rigidity of the portions of the top surface sheet, the front surface sheet, and the back surface sheet near the spout too high, thus allowing the spout to be easily gripped via the front surface sheet and the back surface sheet when opening and closing the spout.

Also, the side enclosing portion preferably includes a column portion elongated in the height direction and a projection portion having a shape projecting inward in the width direction from the column portion.

In this manner, when the side seal portion is gripped and the contents are discharged, the finger of the person gripping catches on the projection portion, allowing the contents to be stably discharged. Furthermore, inward bending of the side seal portion, of the pair of side seal portions, on the opposite side to the side seal portion including the projection portion can be effectively suppressed by a wrinkle being formed at a portion of the front surface sheet and the back surface sheet near the projection portion.

Also, an inner edge portion of the top enclosing portion in a depth direction preferably has a shape that, as the inner edge portion separates from the spout, gradually approaches the top seal portion, of the front top seal portion and the back top seal portion, that is not the top seal portion including the top enclosing portion.

In this manner, volume for the top enclosing portion can be secured, and an increase in the size of the top surface sheet in the depth direction (the direction orthogonal to both the width direction and the height direction) can be prevented.

Also, the side enclosing portion and the top enclosing portion preferably include a communicating portion through which the side enclosing portion and the top enclosing portion communicate with one another; and a cross-sectional area of an end portion of the side enclosing portion on a side where the communicating portion is located and a cross-sectional area of an end portion of the top enclosing portion on a side where the communicating portion is located preferably gradually decrease as the end portion of the side enclosing portion and the end portion of the top enclosing portion approach the communicating portion.

According to this aspect, the gas can be enclosed in all of the enclosing portions with a single enclosing process, and function of each of the enclosing portions of increasing the rigidity of the boundary portion is suppressed. This helps promote the expansion of the top surface sheet.

Advantageous Effects of Invention. According to the present invention, a pouch that can suppress bending of a top surface sheet can be provided.

DESCRIPTION OF EMBODIMENTS

Figure 1:
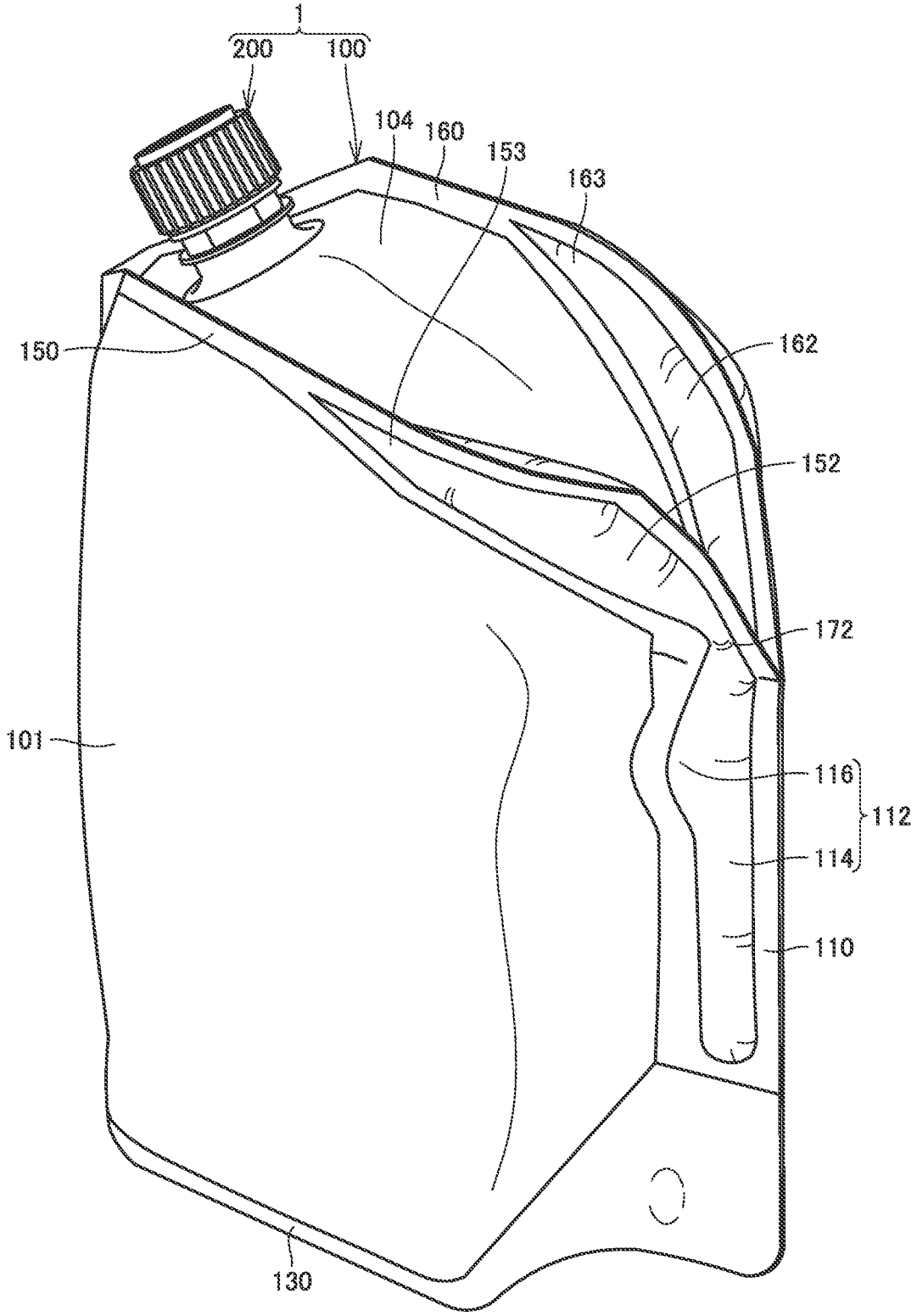
FIG. 1 is a perspective view of a pouch according to an embodiment of the present invention.

Embodiments of the invention will now be described with reference to the drawings. Note that in the drawings referred to below, the same reference numerals are assigned to the same or corresponding members.

FIG. 1 is a perspective view of a pouch according to an embodiment of the present invention. The pouch 1 is suitable as a container for a liquid, a powder, a solid having fluidity, and the like.

As illustrated in FIG. 1, the pouch 1 includes a packaging bag 100 and a spout 200.

Figure 2:
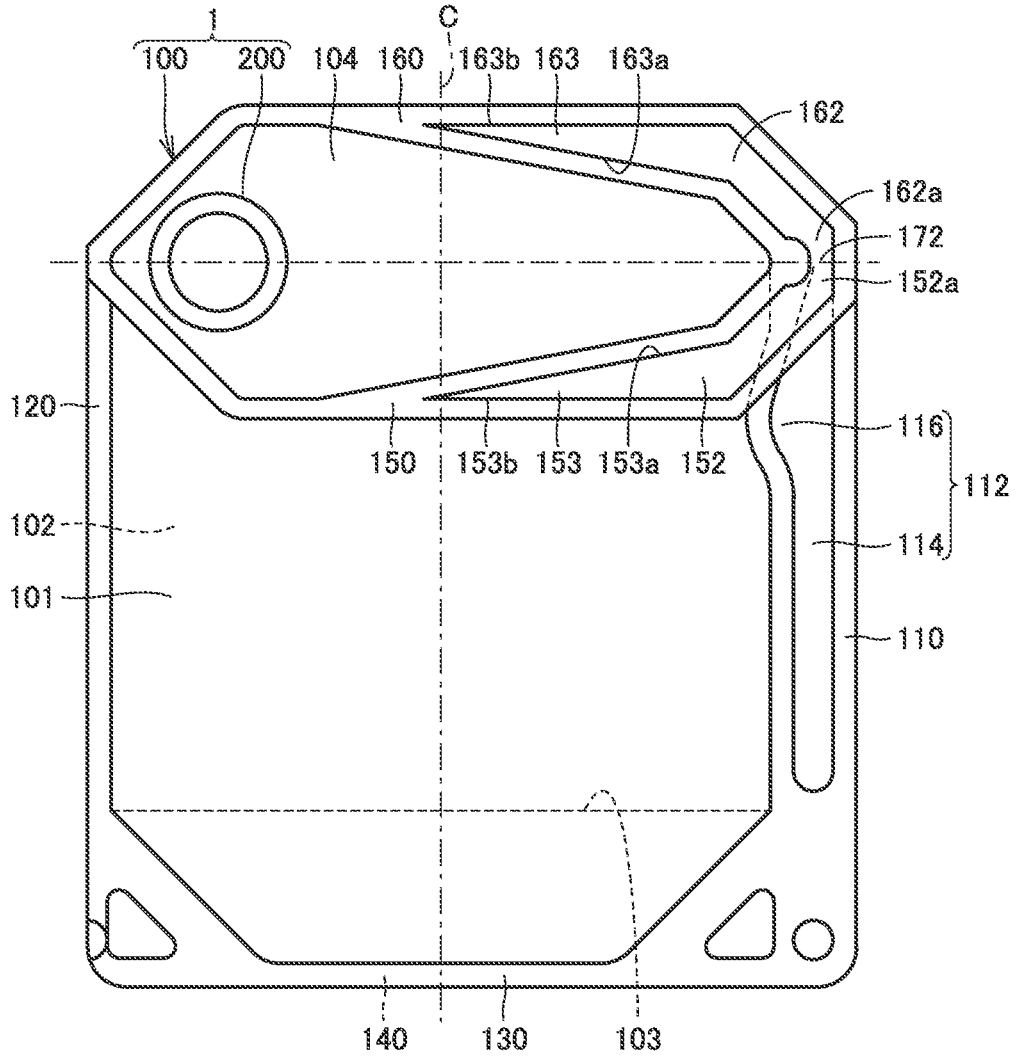
FIG. 2 is a front view of the pouch in a state where no contents are housed and a front surface sheet is bent back at an upper end portion of a side seal portion.

The packaging bag 100 can house contents within. As illustrated in FIG. 2, the packaging bag 100 includes a front surface sheet 101, a back surface sheet 102, a bottom surface sheet 103, and a top surface sheet 104. Each of the sheets 101 to 104 is composed of a layered body containing, for example, polyethylene terephthalate, aluminum, nylon, or polyethylene. The packaging bag 100 is formed by sealing together the peripheral portions of the sheets 101 to 104. Specifically, the packaging bag 100 includes a pair of side seal portions 110, 120, a front bottom seal portion 130, a back bottom seal portion 140, a front top seal portion 150, and a back top seal portion 160. The region on the inner side of each of the seal portions 110 to 160 of the packaging bag 100 form a housing portion for housing the contents. As the method of sealing together the sheets forming the packaging bag 100 and portions fixing the spout 200 to the packaging bag 100, various known methods may be used, with examples including fusing methods, such as heat sealing, ultrasonic wave sealing, and high frequency sealing and an adhesion method using an adhesive.

The pair of side seal portions 110, 120 are formed by sealing together the end portions of the front surface sheet 101 and the end portions of the back surface sheet 102 in the width direction (the left-and-right direction in FIG. 2). Regarding the pair of side seal portions 110, 120, the side seal portion formed at the end portion of the packaging bag 100 on one side in the width direction is referred to as a first side seal portion 110, and the side seal portion formed at the end portion of the packaging bag 100 on the other side in the width direction is referred to as a second side seal portion 120. The side seal portions 110, 120 each have an elongated shape in the height direction (the up-and-down direction in FIG. 2).

The first side seal portion 110 includes a side enclosing portion 112 in which a gas (for example, air) is enclosed, the side enclosing portion 112 having an elongated shape in the height direction. The side enclosing portion 112 has a function to increase the bending rigidity of the first side seal portion 110. The side enclosing portion 112 includes a column portion 114 and a projection portion 116.

The column portion 114 has an elongated shape in the height direction. The column portion 114 is preferably formed in a linear shape. However, the width of the column portion 114 may be constant in the height direction, may gradually increase as the column portion 114 extends from downward to upward, or may gradually decrease as the column portion 114 extends from downward to upward.

The projection portion 116 has a shape projecting from the column portion 114 inward (to the left side in FIG. 2) in the width direction. More specifically, the projection portion 116 has a shape projecting from the column portion 114 toward the housing portion for housing the contents. The inner end portion of the projection portion 116 in the width direction has a curved shape projecting inward in the width direction. As illustrated in FIG. 2, the innermost end portion of the projection portion 116 is preferably formed at a position that does not overlap with the top surface sheet 104 when the front surface sheet 101 is bent back at the upper end portions of the pair of side seal portions 110, 120. Note that the inner end portion of the projection portion 116 may have an elongated shape in the height direction (for example, a reversed C shape formed by the outer edge of the projection portion 116). In this case, a portion (upper portion) of the inner end portion of the projection portion 116 may overlap with the top surface sheet 104.

The front bottom seal portion 130 is formed by sealing together the front surface sheet 101 and the bottom surface sheet 103.

The back bottom seal portion 140 is formed by sealing together the back surface sheet 102 and the bottom surface sheet 103.

The front top seal portion 150 is formed by sealing together the front surface sheet 101 and the top surface sheet 104.

The back top seal portion 160 is formed by sealing together the back surface sheet 102 and the top surface sheet 104.

At least one of the front top seal portion 150 or the back top seal portion 160 includes a top enclosing portion in which a gas is enclosed, the top enclosing portion having an elongated shape in the width direction. In the present embodiment, the front top seal portion 150 and the back top seal portion 160 both include a top enclosing portion.

Hereinafter, the top enclosing portion of the front top seal portion 150 is referred to as a front top enclosing portion 152, and the top enclosing portion of the back top seal portion 160 is referred to as a back top enclosing portion 162.

The front top enclosing portion 152 has a function to increase the bending rigidity of the front top seal portion 150. The front top enclosing portion 152 includes a front tapered region 153. The front tapered region 153 has a shape that gradually decreases in cross-sectional area as the front tapered region 153 separates from the first side seal portion 110 in the width direction. More specifically, an edge portion 153*a* (see FIG. 2) of the front tapered region 153 on the inner side in the depth direction (the direction orthogonal to both the width direction and the height direction) has a shape that gradually extends outward in the depth direction as the edge portion 153*a* separates from the first side seal portion 110. The edge portion 153*a* is formed in a linear shape. However, the edge portion 153*a* may be formed in a curved shape projecting outward in the depth direction, for example. An edge portion 153*b* (see FIG. 2) of the front tapered region 153 on the outer side in the depth direction has a linearly elongated shape that extends orthogonal to the depth direction (in the width direction). The front end of the front tapered region 153 is located on the opposite side (left side in FIG. 2) to the side where the first side seal portion 110 is located, with respect to a central portion C of the housing portion in the width direction. However, the front end of the front tapered region 153 may be located on the side of the central portion C of the housing portion in the width direction where the first side seal portion 110 is located or may be located on the central portion C.

The back top enclosing portion 162 has a function to increase the bending rigidity of the back top seal portion 160. The back top enclosing portion 162 has a shape that is symmetrical to the front top enclosing portion 152 with respect to a plane that is orthogonal to the depth direction and passes through the central portion of the top surface sheet 104 in the depth direction. That is, the back top enclosing portion 162 includes a back tapered region 163, an edge portion 163*a* (see FIG. 2) on the inner side of the back tapered region 163 has a shape that gradually extends outward in the depth direction as the back tapered region 163 separates from the first side seal portion 110, and an edge portion 163*b* (see FIG. 2) on the outer side of the back tapered region 163 has a linearly elongated shape that extends orthogonal to the depth direction (in the width direction).

That is, the portion of the top surface sheet 104 between the front top enclosing portion 152 and the back top enclosing portion 162 has a shape that gradually decreases in length in the depth direction as it separates from the spout 200.

As illustrated in FIG. 2, the side enclosing portion 112, the front top enclosing portion 152, and the back top enclosing portion 162 include a communicating portion 172 through which they communicate with one another. In other words, the side enclosing portion 112, the front top enclosing portion 152, and the back top enclosing portion 162 are formed as a single space. The cross-sectional area of an end portion 112*a* (see FIG. 3) of the side enclosing portion 112 on the side where the communicating portion 172 is located, the cross-sectional area of an end portion 152*a* of the front top enclosing portion 152 on the side where the communicating portion 172 is located, and the cross-sectional area of an end portion 162*a* of the back top enclosing portion 162 on the side where the communicating portion 172 is located gradually decrease as the end portions approach the communicating portion 172. As described above, the side enclosing portion 112 extending in the height direction, the front top enclosing portion 152 extending in the width direction, and the back top enclosing portion 162 extending in the width direction communicate with one another via the communicating portion 172 with a narrow width. In other words, the space within the side enclosing portion 112 branches into two spaces, the space within the front top enclosing portion 152 and the space within the back top enclosing portion 162, at the communicating portion 172.

The spout 200 is the portion for discharging the contents from the packaging bag 100. The spout 200 includes an outlet. The spout 200 is fixed to the top surface sheet 104. In the present embodiment, the spout 200 is fixed to a portion of the top surface sheet 104 separated from the front top enclosing portion 152 and the back top enclosing portion 162 in the width direction. Note that a cap for closing the outlet is attached to the outer circumference of the spout 200.

Next, a method of manufacturing the pouch 1 will be described with reference to FIGS. 3 to 8. The manufacturing method includes a first seal process, an opening process, a top surface sheet placement process, a second seal process, a point seal process, a cutting process, an enclosing process, and a filling process.

Figure 3:
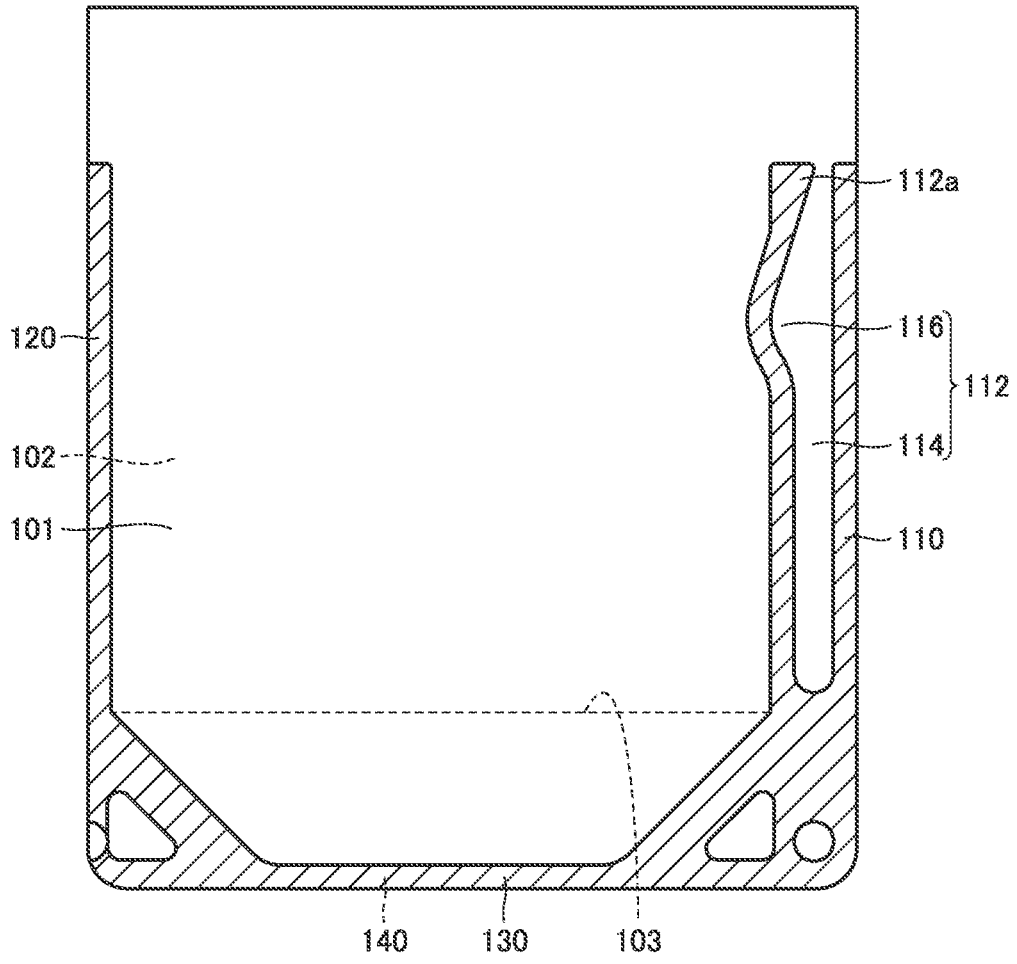
FIG. 3 is a diagram illustrating a process in which the front surface sheet, a back surface sheet, and a bottom surface sheet are sealed together.

In the first seal process, as illustrated in FIG. 3, the peripheral portions of the front surface sheet 101, the back surface sheet 102, and the bottom surface sheet 103 are sealed together. Note that in FIG. 3, the sealed portions are indicated by diagonal lines.

Figure 4:
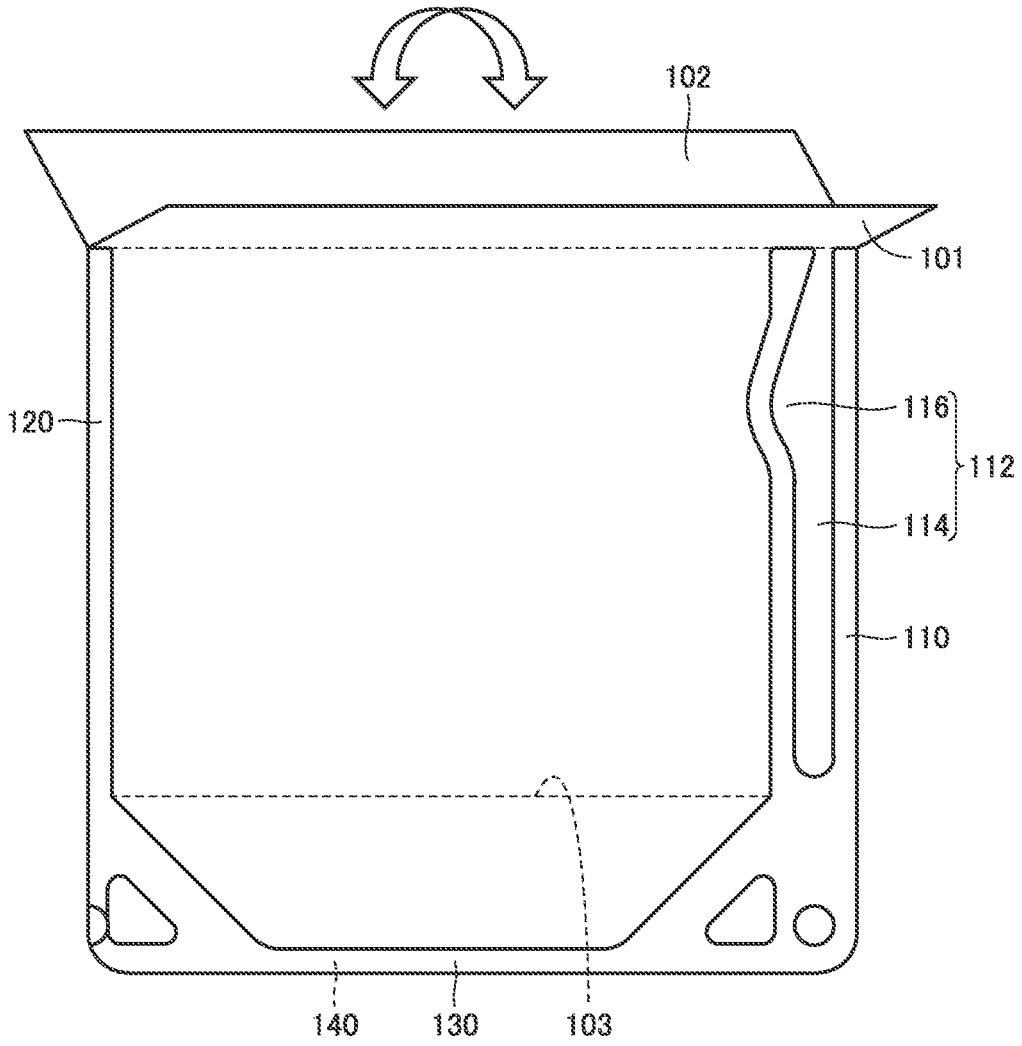
FIG. 4 is a diagram illustrating a process in which an upper portion of the front surface sheet and an upper portion of the back surface sheet are opened.

In the opening process, as illustrated in FIG. 4, the upper portions of the pair of side seal portions 110, 120 of the front surface sheet 101 and the back surface sheet 102 are opened outward and bent back. Note that the upper portions of the front surface sheet 101 and the back surface sheet 102 may be bent back with both opening outward as illustrated in FIG. 4 or only one may be folded back 180 degrees and opened.

Figure 5:
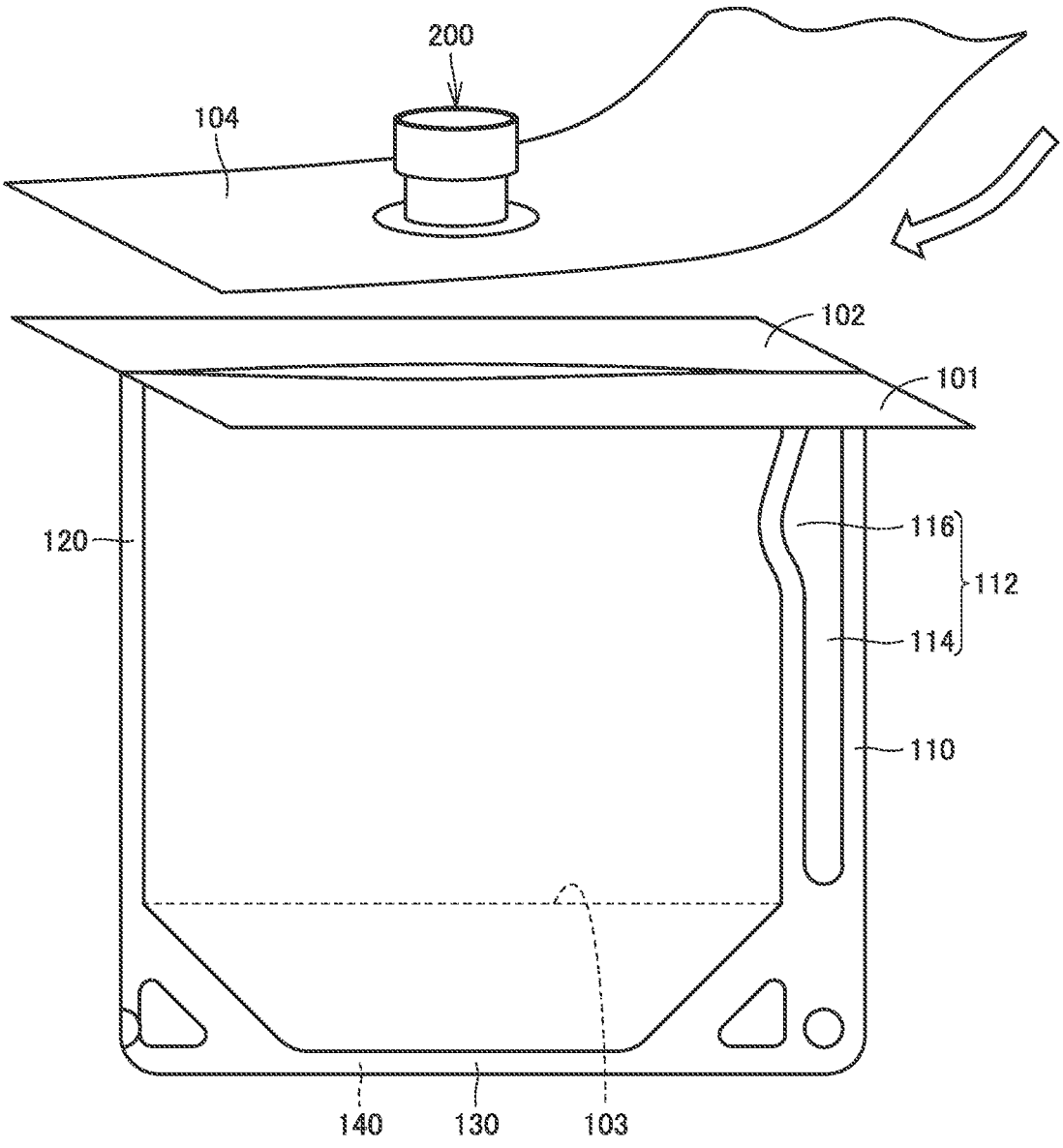
FIG. 5 is a diagram illustrating a process in which a top surface sheet is placed on the upper portion of the front surface sheet and the upper portion of the back surface sheet.

In the top surface sheet placement process, as illustrated in FIG. 5, the top surface sheet 104 with the spout 200 attached is placed on the upper portion of the front surface sheet 101 and the upper portion of the back surface sheet 102.

Figure 6:
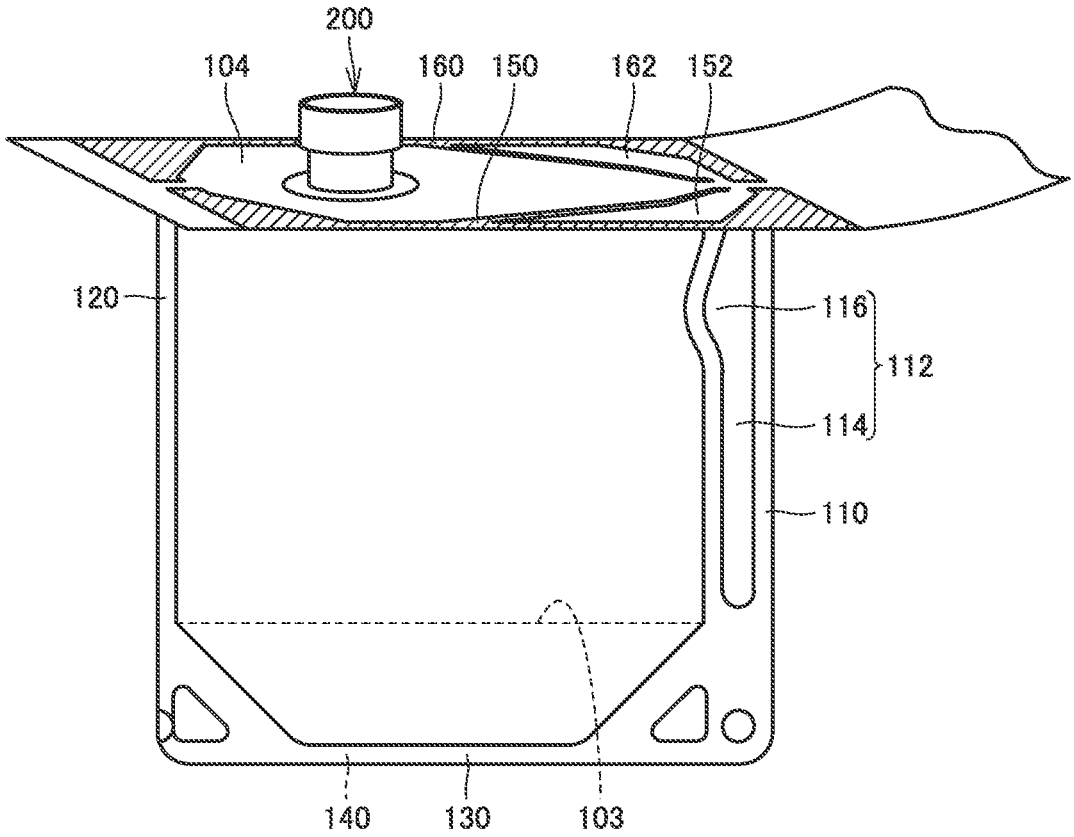
FIG. 6 is a diagram illustrating a process in which the front surface sheet, the back surface sheet, and the top surface sheet are sealed together.

In the second seal process, as illustrated in FIG. 6, the peripheral portions of the front surface sheet 101, the back surface sheet 102, and the top surface sheet 104 are sealed together. Note that in FIG. 6, the sealed portions are indicated by diagonal lines.

Figure 7:
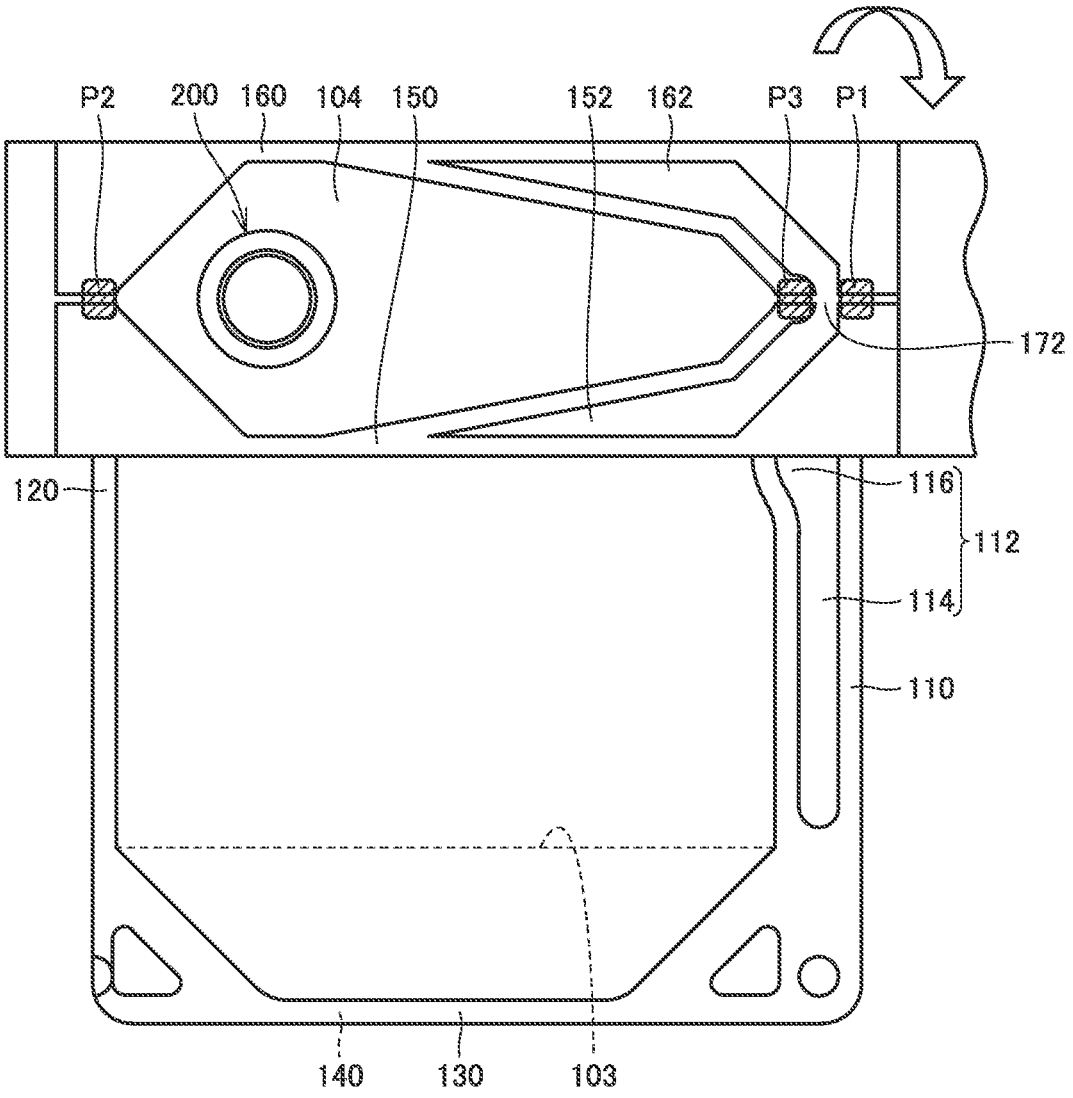
FIG. 7 is a diagram illustrating a process in which each enclosing portion is formed.

In the point seal process, as illustrated in FIG. 7, both end portions P1, P2 of the front top seal portion 150 and the back top seal portion 160 in the width direction and an intersection portion P3 where the inner edge portion of the front top enclosing portion 152 and the inner edge portion of the back top enclosing portion 162 meet are sealed. This process forms three enclosing portions (the side enclosing portion 112, the front top enclosing portion 152, and the back top enclosing portion 162) communicating with one another through the communicating portion 172. Note that in FIG. 7, the sealed portions are indicated by diagonal lines.

Figure 8:
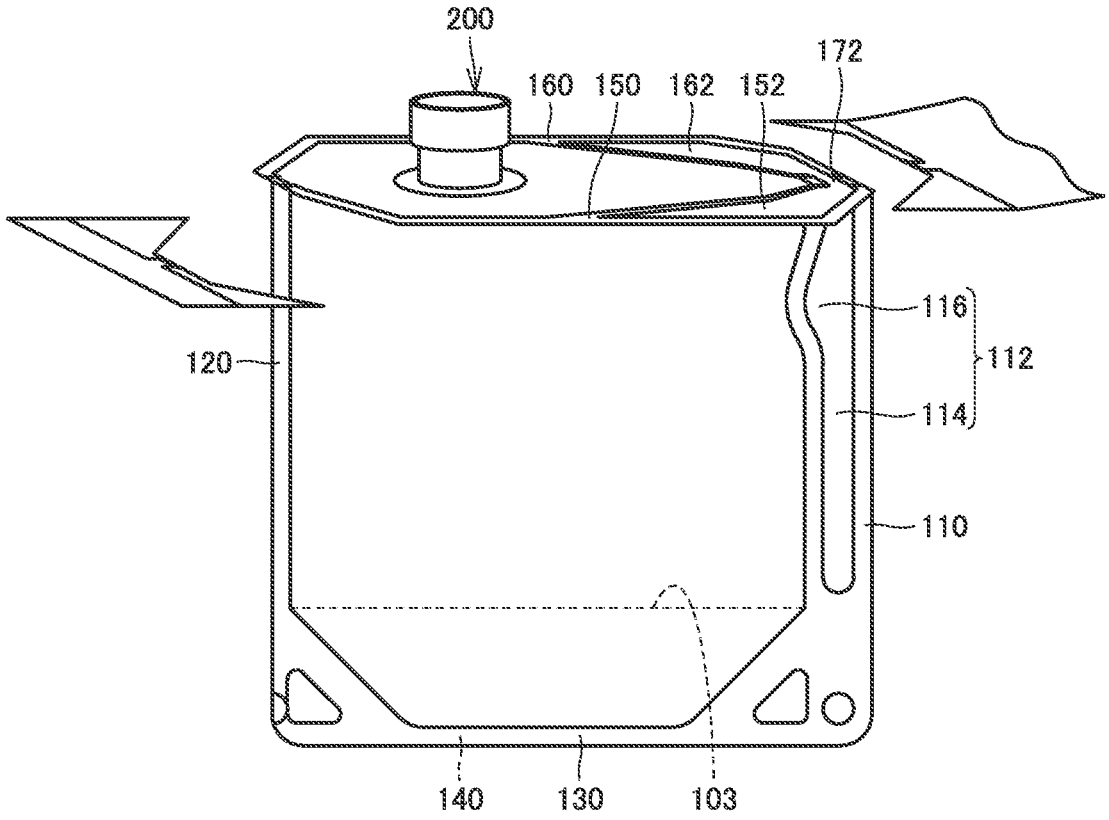
FIG. 8 is a diagram illustrating a process in which unnecessary portions of the front surface sheet, the back surface sheet, and the top surface sheet are cut and removed.

In the cutting process, as illustrated in FIG. 8, unnecessary portions of the front surface sheet 101, the back surface sheet 102, and the top surface sheet 104 are cut and removed.

In the enclosing process, a gas (air or the like) is enclosed in each enclosing portion. In the present embodiment, because the side enclosing portion 112, the front top enclosing portion 152, and the back top enclosing portion 162 communicate with one another, the gas can be enclosed in all of the enclosing portions with a single enclosing operation.

In the filling process, the housing portion of the packaging bag 100 is filled with the contents. For example, in the filling process, the contents are inserted through the spout 200. Note that the filling process may be performed after the enclosing process or before the enclosing process.

In this manner, the pouch 1 is formed. With the pouch 1 including the bottom surface sheet 103 and the top surface sheet 104, volume for the packaging bag 100 is secured, and with the pouch 1 including the front top enclosing portion 152 and the back top enclosing portion 162, bending of the top surface sheet 104 when the contents are discharged from the spout 200 or the pouch 1 is transported is suppressed.

Also, because the spout 200 is fixed to a portion of the top surface sheet 104 separated from the front top enclosing portion 152 and the back top enclosing portion 162 in the width direction, the portions of the top surface sheet 104, the front surface sheet 101, and the back surface sheet 102 near the spout 200 can be prevented from having excessive rigidity due to the front top enclosing portion 152 and the back top enclosing portion 162. Thus, the spout 200 can be easily gripped via the front surface sheet 101 and the back surface sheet 102 when opening and closing the spout 200.

Also, because the side enclosing portion 112 includes the projection portion 116, when the first side seal portion 110 is gripped and the contents are discharged, the finger of the person gripping catches on the projection portion 116, allowing the contents to be stably discharged. Furthermore, inward bending of the second side seal portion 120 can be effectively suppressed by a wrinkle being formed at a portion of the front surface sheet 101 and the back surface sheet 102 near the projection portion 116.

Also, because the portion of the top surface sheet 104 between the front top enclosing portion 152 and the back top enclosing portion 162 has a shape that gradually decreases in length in the depth direction as it separates from the spout 200, volume for each of the top enclosing portions 152, 162 can be secured, and an increase in the size of the top surface sheet 104 in the depth direction can be prevented.

Furthermore, because the cross-sectional area of the end portion 112*a* of the side enclosing portion 112 on the side where the communicating portion 172 is located, the cross-sectional area of the end portion 152*a* of the front top enclosing portion 152 on the side where the communicating portion 172 is located, and the cross-sectional area of the end portion 162*a* of the back top enclosing portion 162 on the side where the communicating portion 172 is located gradually decrease as the end portions approach the communicating portion 172, the function of each of the enclosing portions 112, 152, 162 to increase the rigidity is suppressed at portions near the communicating portion 172. This helps promote the expansion of the top surface sheet 104. In addition, because the portion near the communicating portion 172 functions as a gripping portion, the pouch 1 is made easier to grip.

Note that everything described in the embodiment described above is to be understood as being an example, and no limitation is intended. The scope of the present invention is defined by the claims and not the embodiments described above, and meanings equivalent to those of the claims and all modifications made within the claims are also included.

For example, a side enclosing portion can be formed in both the first side seal portion 110 and the second side seal portion 120.

Also, for example, any one of the front top enclosing portion 152 and the back top enclosing portion 162 may be omitted. In this case, the inner edge portion of the top enclosing portion in the depth direction is formed in a shape that, as it separates from the spout 200, the inner edge portion gradually approaches the top seal portion, of the front top seal portion 150 and the back top seal portion 160, that is not the top seal portion including the top enclosing portion.

Figure 9:
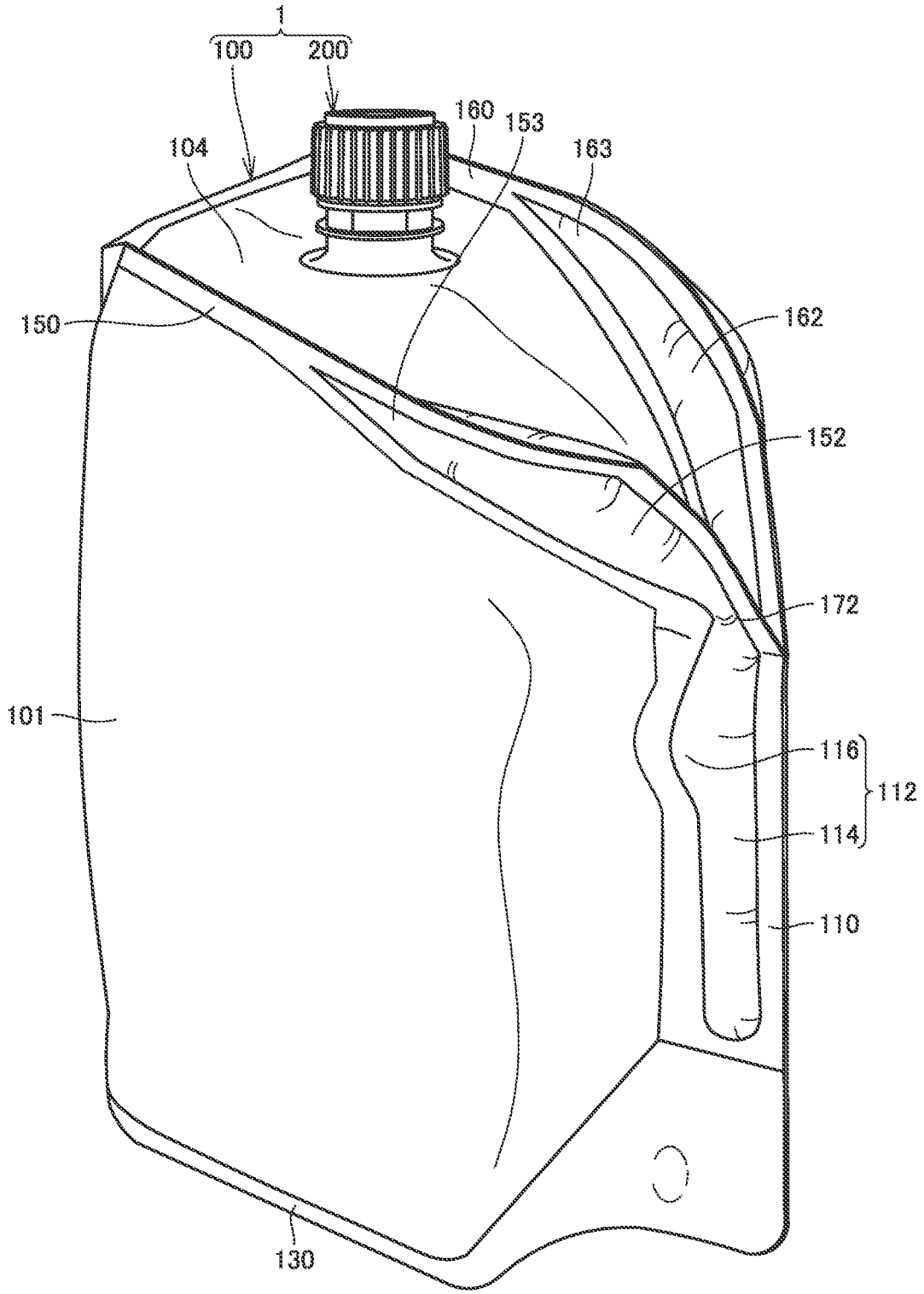
FIG. 9 is a perspective view illustrating a pouch according to a first modified example.
Figure 10:
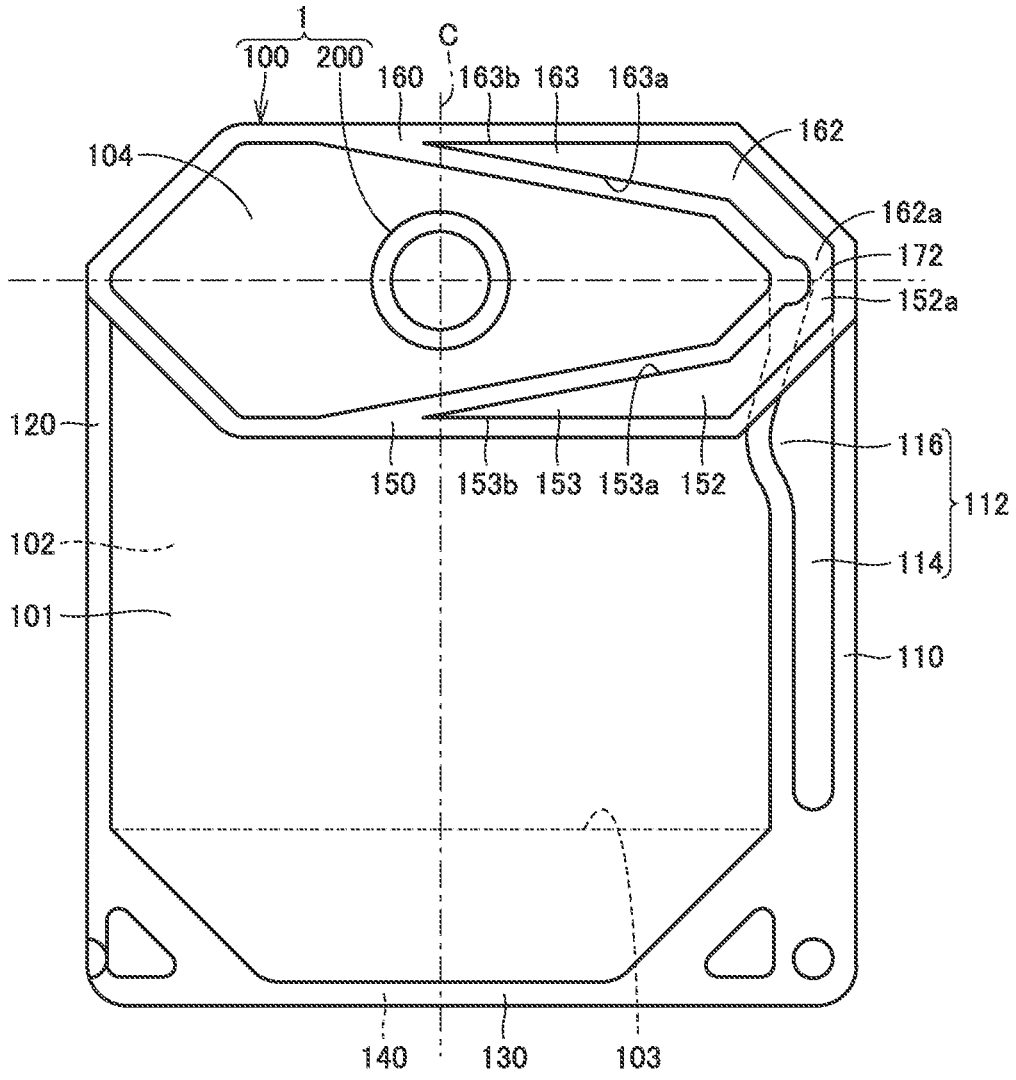
FIG. 10 is a front view illustrating the pouch according to the first modified example in a state where no contents are housed and a front surface sheet is bent back at an upper end portion of a side seal portion.

Also, as illustrated in FIGS. 9 and 10, the spout 200 may be fixed to the central portion of the top surface sheet 104 in the width direction. In this case, the front top enclosing portion 152 and the back top enclosing portion 162 may be formed in a connected annular shape surrounding the spout 200. Furthermore, in this case, all of the enclosing portions preferably communicate with one another.

Figure 11:
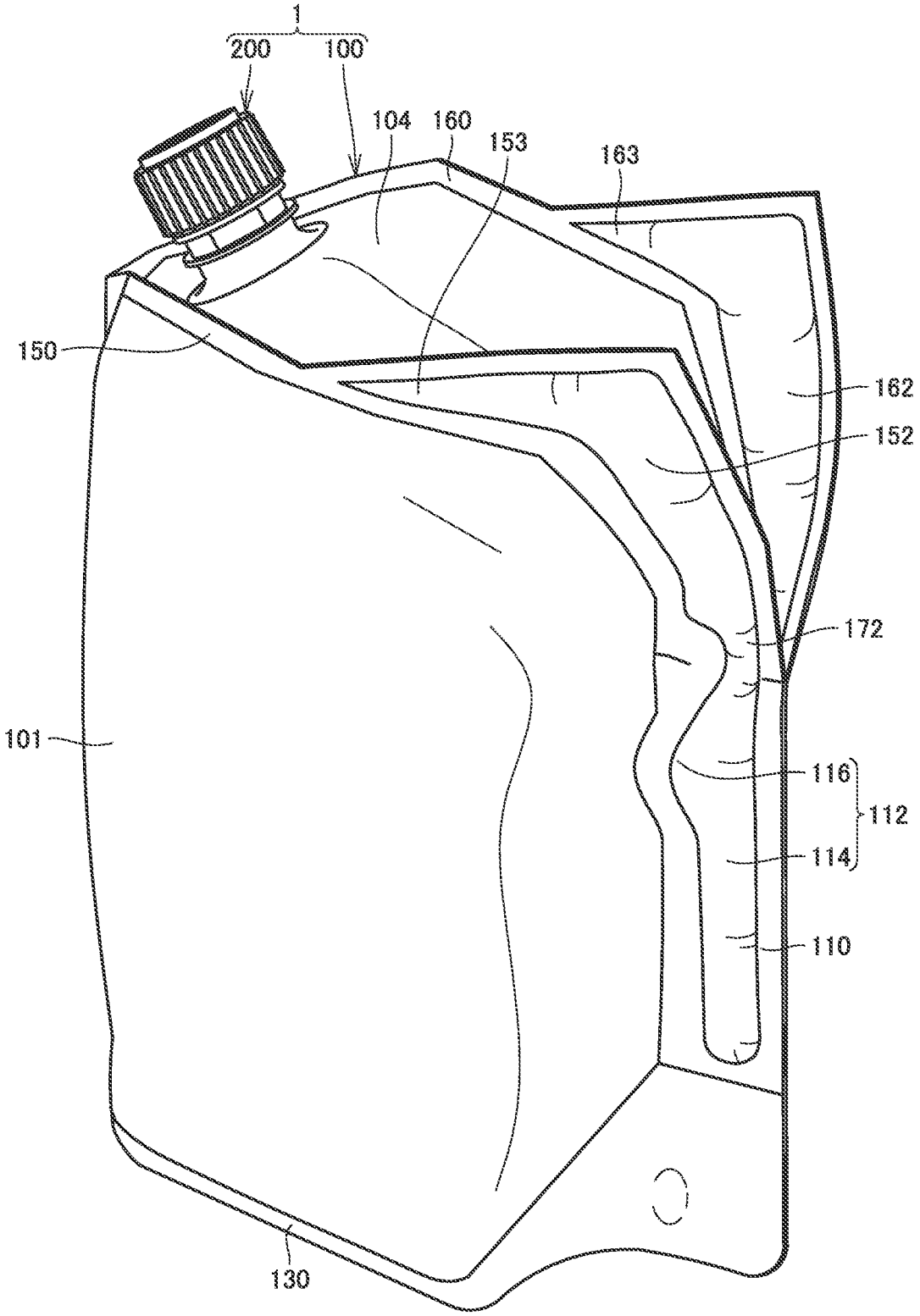
FIG. 11 is a perspective view illustrating a pouch according to a second modified example.
Figure 12:
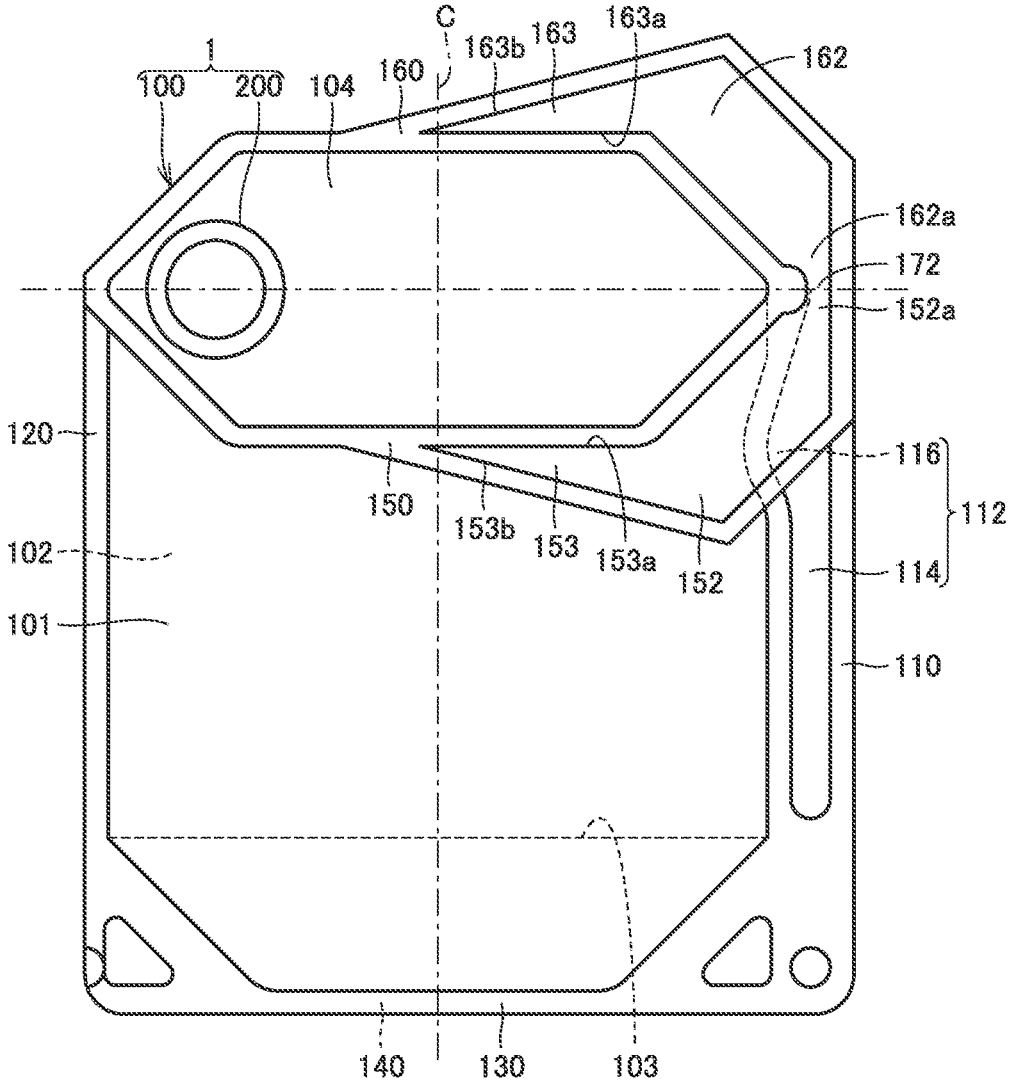
FIG. 12 is a front view illustrating the pouch according to the second modified example in a state where no contents are housed and a front surface sheet is bent back at an upper end portion of a side seal portion.

Also, as illustrated in FIGS. 11 and 12, the inner edge portion 153*a* of the front tapered region 153 and the inner edge portion 163*a* of the back tapered region 163 may have a linearly elongated shape that orthogonally intersects the depth direction, and the outer edge portion 153*b* of the front tapered region 153 and the outer edge portion 163*b* of the back tapered region 163 may have a shape that gradually extends outward in the depth direction as they separate from the spout 200.

REFERENCE SIGNS LIST

1 Pouch
100 Packaging bag
101 Front surface sheet
102 Back surface sheet
103 Bottom surface sheet
104 Top surface sheet
110 First side seal portion
112 Side enclosing portion
112*a* End portion
114 Column portion
116 Projection portion
120 Second side seal portion
130 Front bottom seal portion
140 Back bottom seal portion
150 Front top seal portion
152 Front top enclosing portion
152*a* End portion
153 Front tapered region
160 Back top seal portion
162 Back top enclosing portion
162*a* End portion
163 Back tapered region
172 Communicating portion
200 Spout

What is claimed is:

1. A pouch, comprising:

a packaging bag including a front surface sheet, a back surface sheet, a bottom surface sheet, and the top surface sheet and configured to house contents; and a spout fixed to the top surface sheet and configured to discharge the contents from the packaging bag, wherein the packaging bag includes a pair of side seal portions formed by sealing together end portions of the front surface sheet and end portions of the back surface sheet in a width direction and each having an elongated shape in a height direction, a front bottom seal portion formed by sealing together the front surface sheet and the bottom surface sheet, a back bottom seal portion formed by sealing together the back surface sheet and the bottom surface sheet, a front top seal portion formed by sealing together the front surface sheet and the top surface sheet, and a back top seal portion formed by sealing together the back surface sheet and the top surface sheet, at least one of the pair of side seal portions includes a side enclosing portion in which a gas is enclosed, the side enclosing portion having an elongated shape in the height direction, and at least one of the front top seal portion or the back top seal portion includes a top enclosing portion in which a gas is enclosed, the top enclosing portion having an elongated shape in the width direction.

2. The pouch according to claim 1, wherein the spout is fixed to a portion of the top surface sheet separated from the top enclosing portion in the width direction.

3. The pouch according to claim 2, wherein the side enclosing portion includes a column portion elongated in the height direction and a projection portion having a shape projecting inward in the width direction from the column portion.

4. The pouch according to claim 2, wherein an inner edge portion of the top enclosing portion in a depth direction has a shape that, as the inner edge portion separates from the spout, gradually approaches the top seal portion, of the front top seal portion and the back top seal portion, that is not the top seal portion including the top enclosing portion.

5. The pouch according to claim 1, wherein the side enclosing portion and the top enclosing portion include a communicating portion through which the side enclosing portion and the top enclosing portion communicate with one another, and a cross-sectional area of an end portion of the side enclosing portion on a side where the communicating portion is located and a cross-sectional area of an end portion of the top enclosing portion on a side where the communicating portion is located gradually decrease as the end portion of the side enclosing portion and the end portion of the top enclosing portion approach the communicating portion.

6. The pouch according to claim 1, wherein, the front surface sheet is composed of one sheet;

the back surface sheet is composed of one sheet; and the side enclosing portion is formed by unsealed area of the side seal portion.

* * * * *